US005417566A

United States Patent [19]

Ishikawa et al.

[11] Patent Number: 5,417,566

[45] Date of Patent: May 23, 1995

[54] METHOD OF PREVENTING BURNING RESONANCE NOISE AND A BURNER PLATE

[75] Inventors: Hideaki Ishikawa; Hideyuki Jinno, both of Nagoya, Japan

[73] Assignee: Rinnai Kabushiki Kaisha, Japan

[21] Appl. No.: 155,597

[22] Filed: Nov. 22, 1993

[30] Foreign Application Priority Data

Dec. 14, 1992 [JP] Japan ..... 4-333120

[51] Int. Cl.[6] ..... F23D 14/12

[52] U.S. Cl. ..... 431/328

[58] Field of Search ..... 431/7, 328, 329

[56] References Cited

U.S. PATENT DOCUMENTS

| | | | |
|---|---|---|---|
| 1,063,412 | 6/1913 | Buckman | 431/328 |
| 1,146,724 | 7/1915 | Lucke | 431/328 |
| 2,121,948 | 6/1938 | Borland | 431/328 |
| 4,439,136 | 3/1984 | Pfefferle | 431/328 |

FOREIGN PATENT DOCUMENTS

| | | | |
|---|---|---|---|
| 600022 | 10/1925 | France | 431/328 |
| 1283179 | 12/1961 | France | 431/328 |
| 1341665 | 9/1963 | France | 431/328 |
| 56-28533 | 3/1981 | Japan . | |
| 56-121929 | 9/1981 | Japan . | |

*Primary Examiner*—Carroll B. Dority

*Attorney, Agent, or Firm*—Sughrue, Mion, Zinn, Macpeak & Seas

[57] ABSTRACT

In a burner plate having a multitude of fire holes each piercing through its thickness so as to effect a primary burning thereon with a high heat capacity, it is adapted to continuously differentiate a time period required for an air-fuel mixture gas to pass through the fire holes of the burner plate from a central portion toward an outer periphery of the burner plate.

4 Claims, 10 Drawing Sheets

METHOD OF PREVENTING BURNING RESONANCE NOISE AND A BURNER PLATE

BACKGROUND OF THE INVENTION

1. Field of the Invention

This invention relates to a method of preventing burning resonance noise and a burner plate on which a primary burning is effected with a high heat capacity.

2. Description of Prior Art

In a burner apparatus, a burner plate is provided which has a multitude of fire holes each piercing through its thickness. The burner plate is placed between an upper end of an air-fuel passage in which a burner fan is disposed and a burner chamber in which a primary burning is effected with a high heat capacity. An acoustic system is formed which has a certain volume and configuration determined by the burner chamber, the air-fuel passage and an exhaust passage led from the air-fuel passage. The acoustic system has a characteristic frequency, and an acoustic resonance frequency appears to induce a burning resonance noise when a frequency response of a resonance burning heat frequency in the burner chamber has a certain relationship with the characteristic frequency of the acoustic system. The acoustic resonance frequency is induced when a phase of the frequency response of a resonance burning heat frequency is in a superposing relationship with a phase of the characteristic frequency of the acoustic system.

Therefore, it is one of the objects of the invention to provide a method of preventing burning resonance noise by effectively altering frequency characteristics of burner flame so that the phase of the frequency response of a resonance burning heat frequency is not in a superposing relationship with a phase of the characteristic frequency of the acoustic system.

It is also one of the objects of the invention to provide a burner plate which is capable of preventing the burning resonance noise when a primary burning is effected on the burner plate with a high heat capacity.

SUMMARY OF THE INVENTION

According to the invention, there is provided a method of preventing burning resonance noise comprising steps of: preparing a burner plate having a multitude of fire holes each piercing through its thickness so as to effect a primary burning thereon with a high heat capacity; and continuously differentiating a time period required for an air-fuel mixture gas to pass through the fire holes of the burner plate from a central portion toward an outer periphery of the burner plate.

The arrangement of the fire holes is such that there arises consecutive time differences among the burner flames formed in the fire holes, and the burning heat frequency precedently occurs in the fire holes in which the air-fuel mixture gas passes more quickly, thus making it possible to effectively alter the characteristics of the frequency response on the burner plate.

According further to the invention, there is provided a burner plate comprising: a multitude of fire holes each piercing through its thickness so as to effect a primary burning thereon with a high heat capacity; and a thickness of the burner plate being progressively increased or reduced from a central portion toward an outer periphery of the burner plate.

As a rule, the burner flame formed in the fire holes is repeatedly elongated and contracted to periodically oscillate due to the change of heating capacity when the volume of the burner flame greatly varies under the influence of combustion and pressure variation of the air-fuel mixture gas passing through the fire holes as shown in FIGS. 1*a*, 1*b*.

However, the thickness of the burner plate progressively increases or decreases from a central portion toward an outer periphery of the burner plate. This makes it possible to change the time period needed for the air-fuel mixture gas to pass through the fire holes depending on what part of the burner plate the fire holes are placed. In this instance, the burning heat frequency precedently occurs in the fire holes provided on a thinner portion of the burner plate through which the air-fuel mixture gas passes more quickly, thus making it possible to effectively alter the characteristics of the frequency response on the burner plate.

According furthermore to the invention, there is provided a burner plate comprising: a multitude of fire holes each piercing through its thickness so as to effect a primary burning thereon with a high heat capacity; a countersink provided on an upper end of the fire holes to increase their diameter; a depth of the countersink being progressively increased or reduced from a central portion toward an outer periphery of the burner plate.

As a rule, the burner flame formed in the fire holes is repeatedly elongated and contracted to periodically oscillate due to the change of heating capacity when the volume of the burner flame greatly varies under the influence of combustion and pressure variation of the air-fuel mixture gas passing through the fire holes as shown in FIGS. 1*a*, 1*b*.

However, a countersink is provided on the fire holes so that the depth of the countersink progressively increases or reduces from a central portion toward an outer periphery of the burner plate.

This makes it possible to change the time period needed for the air-fuel mixture gas to pass through the fire holes due to the reason that the flow speed of the air-fuel mixture gas changes depending on the depth of the countersink. Thus, there arises consecutive time differences among the burner flame formed in the fire holes. The burning heat frequency precedently occurs in the fire holes having a shallow countersink through which the air-fuel mixture gas passes more quickly, and thus making it possible to effectively alter the characteristics of the frequency response on the burner plate.

The frequency response of the burning heat frequency provided by the resultant frequency of the burner flames on the entire burner plate repeatedly changes from $\alpha$-state to $\beta$-state and vice versa as shown in FIG. 2*a*. As a result, a time lag occurs in the increment of the heat generation speed on the entire burner plate as opposed to the case in which the same time period is required for the air-fuel mixture gas to pass through the fire holes irrespective of where the fire holes are located on the burner plate. This makes it possible to lag the phase of the frequency response of the burner heat frequency behind the characteristic frequency wave of the acoustic system, and thus enabling to avoid the resonance with the characteristic frequency wave of the acoustic system. Further, it is possible to cancel the frequency response of the burner heat frequency of the burner flame in $\alpha$-state with that of the burner flame in $\alpha$-state so as to decrease the amplitude of the entire frequency response of the burner heat frequency.

However, in the burner plate in which the passage time needed for the air-fuel mixture to pass the fire holes is altered only by randomly changing the diameter of the fire holes, the time lag of the oscillating wave based on different passage time is cancelled between the neighbouring flames. This makes it impossible to effect the state change in the frequency response of the burner heat frequency of the burner flame on the entire burner plate, thus negating an effective prevention of the resonance as shown in FIG. 2*b*.

These and other objects, aspect and embodiments of the invention will be described in more detail with reference to the following drawing figures, of which:

FIG. 1*a* is an explanatory view of how burner flames is repeatedly elongated and contracted on a burner plate;

FIG. 1*b* is an explanatory view of how the oscillating wave occurs on the burner plate by the repeated elongation and contraction of the burner flames in the prior art;

FIG. 2*a* is an explanatory view of how oscillating wave occurs by the burner flames on the burner plate;

FIG. 2*b* is an explanatory view of how oscillating wave occurs by the burner flames on the burner plate in the prior art;

FIG. 3*a* is a plan view of a burner plate according to a first embodiment of the invention;

FIG. 3*b* is a longitudinal cross sectional view taken along the line A1—A1 of FIG. 3*a;*

FIG. 4*a* is a plan view of a burner plate according to a second embodiment of the invention;

FIG. 4*b* is a longitudinal cross sectional view taken along the line B1—B1 of FIG. 4*a;*

FIG. 5*a* is a plan view of a burner plate according to a third embodiment of the invention;

FIG. 5*b* is a longitudinal cross sectional view taken along the line C1—C1 of FIG. 5*a;*

FIG. 6*a* is a plan view of a burner plate according to a fourth embodiment of the invention;

FIG. 6*b* is a longitudinal cross sectional view taken along the line D1—D1 of FIG. 6*a;*

FIG. 7*a* is a plan view of a burner plate according to a fifth embodiment of the invention;

FIG. 7*b* is a longitudinal cross sectional view taken along the line E1—E1 of FIG. 7*a;*

FIG. 8*a* is a plan view of a burner plate according to a sixth embodiment of the invention;

FIG. 8*b* is a longitudinal cross sectional view taken along the line F1—F1 of FIG. 8*a;*

FIG. 9*a* is a plan view of a burner plate according to a seventh embodiment of the invention; FIG. 9*b* is a longitudinal cross sectional view taken along the line G1—G1 of FIG. 9*a;*

FIG. 10*a* is a plan view of a burner plate according to an eigth embodiment of the invention;

FIG. 10*b* is a longitudinal cross sectional view taken along the line H1—H1 of FIG. 10*a;*

FIG. 11*a* is a plan view of a burner plate according to a ninth embodiment of the invention;

FIG. 11*b* is a longitudinal cross sectional view taken along the line I1—I1 of FIG. 11*a;*

FIG. 12*a* is a plan view of a burner plate according to a tenth embodiment of the invention;

FIG. 12*b* is a longitudinal cross sectional view taken along the line J1—J1 of FIG. 12*a;*

FIG. 13 is a longitudinal cross sectional view of a water heating apparatus into which the burner plate is incorporated;

FIG. 14*a* is a plan view of a burner plate according to an eleventh embodiment of the invention;

FIG. 14*b* is a longitudinal cross sectional view taken along the line K1—K1 of FIG. 14*a;*

FIG. 15*a* is a region in which a resonance occurs in a graph showing a relationship between a calorific input and revolution of a blower fan when the burner is incorporated into the water heating apparatus;

FIG. 15*b* is a region in which a resonance occurs in a graph showing a relationship between a calorific input and revolution of a blower fan when the prior art burner is incorporated into the water heating apparatus;

FIG. 16*a* is a plan view of a burner plate according to a twelfth embodiment of the invention;

FIG. 16*b* is a longitudinal cross sectional view taken along the line L1—L1 of FIG. 16*a* when a concave envelope curve is formed by connecting bottoms of countersinks provided in fire holes; and FIG. 16*c* is a view similar to FIG. 16*b* according to a modification form of the twelfth embodiment of the invention when a V-shaped envelope is formed by connecting the bottoms of the countersinks provided in the fire holes.

DETAILED DESCRIPTION OF THE PREFERRED EMBODIMENTS OF THE INVENTION

Figure 1A:
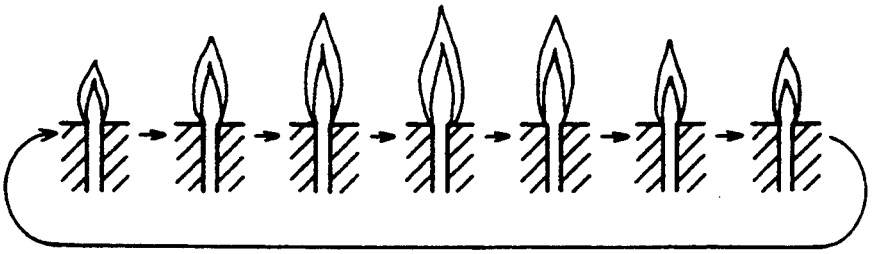
Figure 1A:
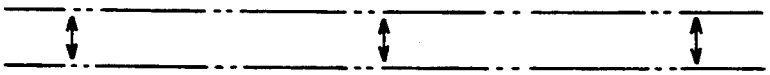
Figure 1B:
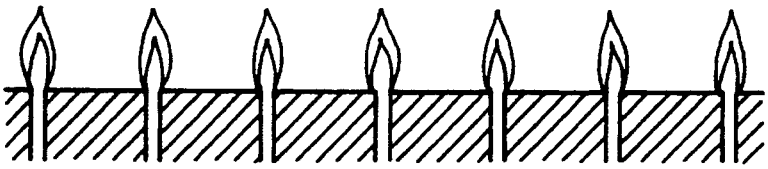
Fig. 1b Prior Art
Figure 1B:
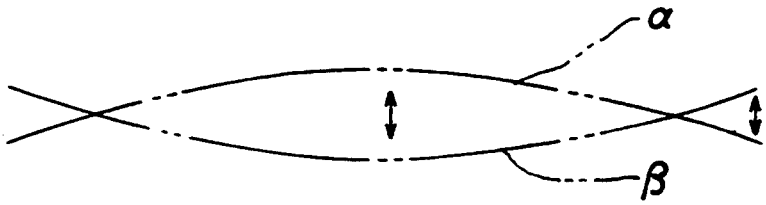
Fig. 1b Prior Art

FIGS. 3 through 7 show in turn burner plates A, B, C, D and E according to first through fifth embodiments of the invention. FIGS. 8 through 10 show in turn burner plates F, G and H according to sixth through eighth embodiments of the invention. Further, FIGS. 11 and 12 show in turn burner plates I and J according to ninth and tenth embodiments of the invention. Each of the burner plates A through J is made of heat-resistant ceramic material, and incorporated into a water heating apparatus U to effect an entire primary burning with a high calorific capacity as shown in FIG. 13. The water heating apparatus U has a burner chamber 102 in which a heat exchanger 101 is placed to produce a compact structure as a whole. The water heating apparatus U is space-saving such that it is usually installed under the kichen bay window, the eaves, the veranda or the like. In the water heating apparatus U, a blower 103 forces an air-fuel mixture gas into a mixing room 104 located upstream of the burner plate A (B~J). The air-fuel mixture gas burns in the burner chamber 102 located downstream of the burner plate A (B~J) on which burner flames are built to heat water flowing through the heat exchanger 101 so as to substantially always supply about 60° C. hot water irrespective of an amount of flowing water (2.9~10.9 l/min). In this instance, an amount of calorific input changes within the range from 6000 kcal to 30000 kcal, and a burner control device 105 controls a proportional valve 106 and the blower 103 so that an amount of gas and air is appropriate to the calorific input. It is noted that in addition to artificially synthesized fuel, the gas may categorically include all the fossil fuels such as liquefied natural gas, kerosine, heavy and light oil.

Figure 3A:
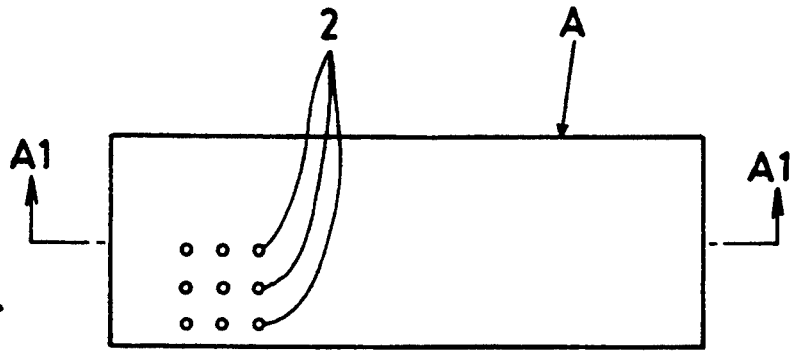
Figure 3B:
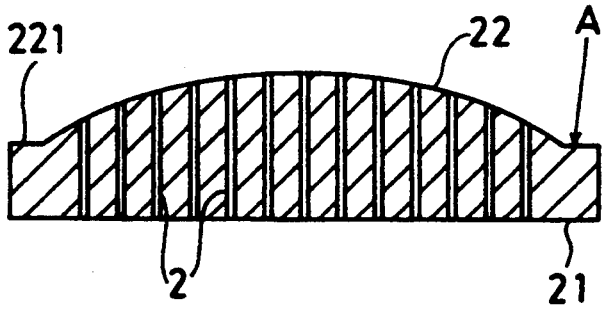

According to the first embodiment of the invention, the burner plate A measures 92 mm×140 mm and 13~23 mm in thickness as shown in FIGS. 3*a*, 3*b*. The burner plate A has a convex-shaped configuration at its upper surface 22, and has a multitude of lattice-like fire holes 2 each piercing through its thickness. Each of the fire holes 2 measures 1.9 mm in diameter and 4 mm in center-to-center distance. In an outer periphery of the burner plate A, the upper surface 22 is in parallel with a lower surface 21 to be readily installed in the burner chamber 102.

Figure 4A:
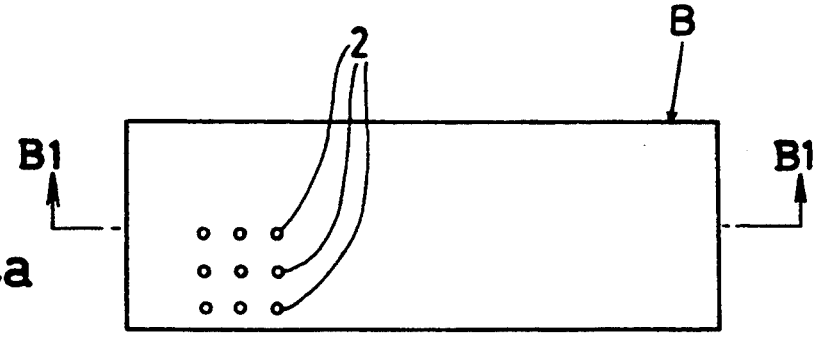
Figure 4B:
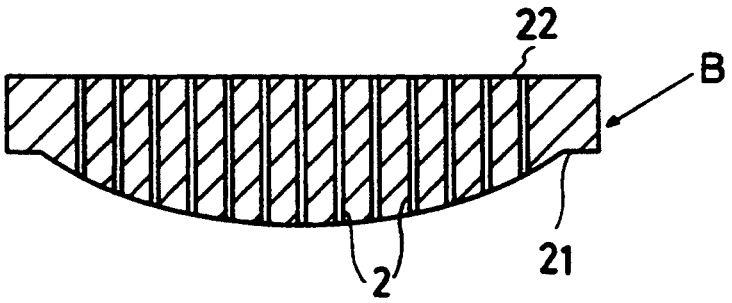

FIGS. 4*a*, 4*b* show the second embodiment of the invention in which the burner plate B has convex configuration at its lower surface 21 as diametrically opposed to the first embodiment of the invention.

Figure 5A:
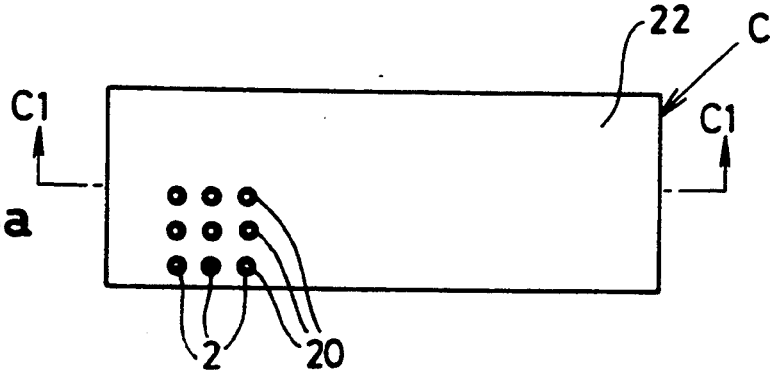
Figure 5B:
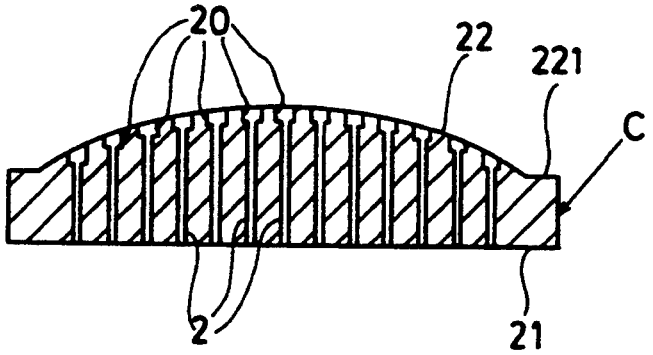

FIGS. 5*a*, 5*b* show the third embodiment of the invention in which the burner plate C has a countersink 20 provided on the upper surface 22 of the fire holes 2 of the burner plate A. It is noted that the countersink 20 measures 4.5 mm in diameter and 1.5 mm in depth. The provision of the countersink 20 makes it possible to slow the air-fuel mixture gas flowing through the fire holes 2 so as to stabilize the flames on the burner plate.

Figure 6A:
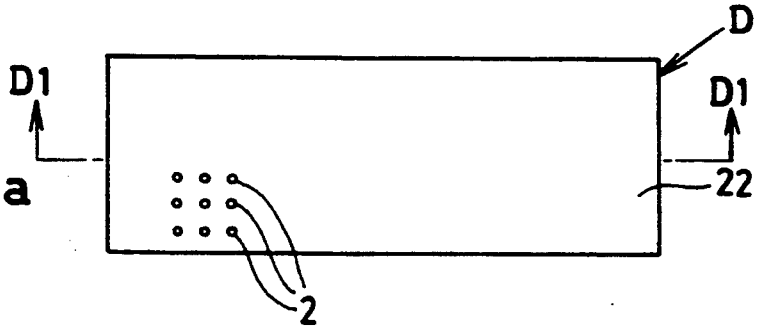
Figure 6B:
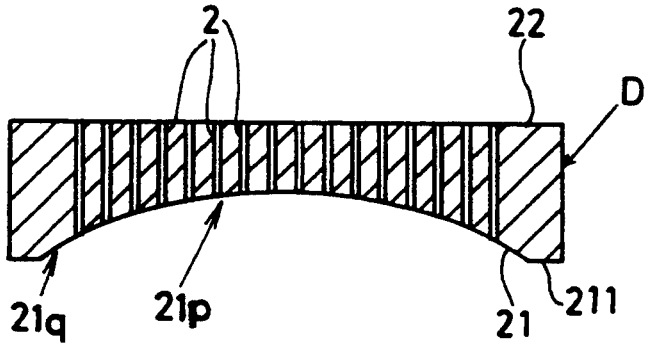

FIGS. 6*a*, 6*b* show the fourth embodiment of the invention in which the burner plate D measures 92 mm×140 mm and 13~23 mm in thickness in the same manner as described in FIGS. 3*a*, 3*b*. The burner plate D has a flat upper surface 22 and the concave lower surface 21, a thickness of which progressively increases from a central portion 21*p* toward an outer periphery 21*q*. The burner plate D has the lattice-like fire holes 2, each of which measures 1.7 mm in diameter and 3 mm in center-to-center distance. In an outer periphery of the burner plate D, the upper surface 22 is in parallel with a lower surface 21 to be readily installed in the burner chamber 102.

Figure 7A:
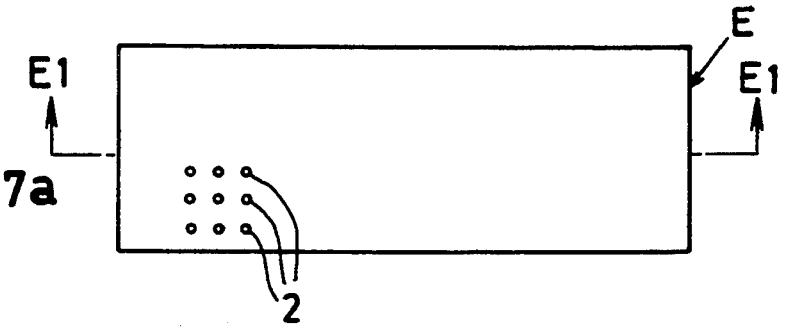
Figure 7B:
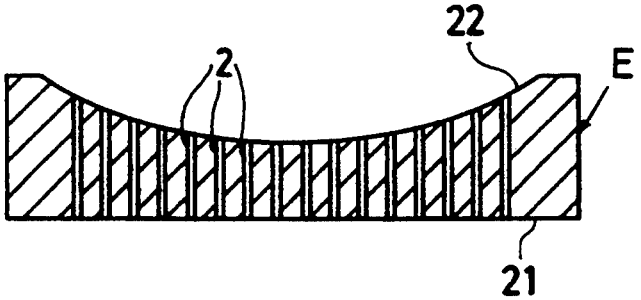

FIGS. 7*a*, 7*b* show the fifth embodiment of the invention in which the burner plate E has concave configuration at its upper surface 22 as diametrically opposed to the fourth embodiment of the invention.

According to the invention, advantages are obtained as follows:

The thickness of the burner plate progressively increases or reduces from a central portion toward an outer periphery of the burner plate. This makes it possible to change the time period needed for the air-fuel mixture gas to pass through the fire holes depending on what part of the burner plate the fire holes are placed. In this instance, the burning heat frequency precedently occurs in the fire holes provided on a thinner portion of the burner plate through which the air-fuel mixture gas passes more quickly, and thus making it possible to effectively alter the characteristics of the frequency response on the burner plate.

Figure 2A:
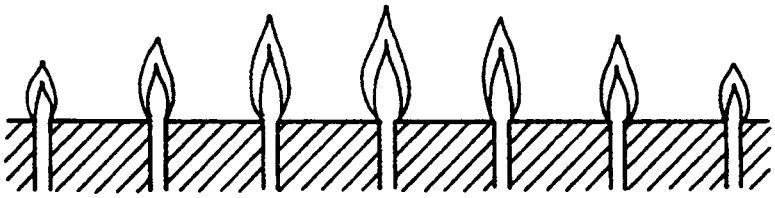
Figure 2A:
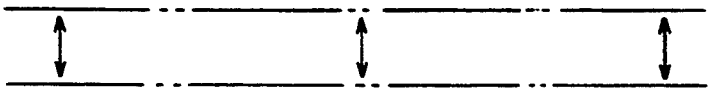
Figure 2B:
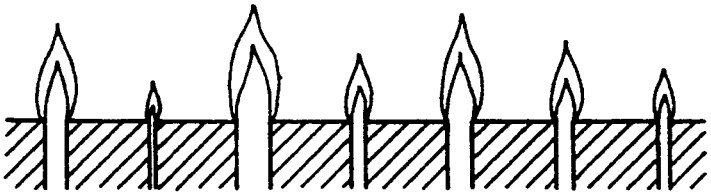

The frequency response of the burning heat frequency provided by the resultant frequency of the burner flames on the entire burner plate repeatedly changes from $\alpha$-state to $\beta$-state and vice versa as shown in FIG. 2*a*. As a result, a time lag occurs in the increment of the heat generation speed on the entire burner plate as opposed to the case in which the same time period is required for the air-fuel mixture gas to pass through the fire holes irrespective of where the fire holes are located on the burner plate. This makes it possible to lag the phase of the frequency response of the burner heat frequency behind the characteristic frequency wave of the acoustic system, and thus enabling to avoid the resonance with the characteristic frequency wave of the acoustic system. Further, it is possible to cancel the frequency response of the burner heat frequency of the burner flame in $\alpha$-state with that of the burner flame in $\beta$-state so as to decrease the amplitude of the entire frequency response of the burner heat frequency. The reduced amplitude of frequency response makes it possible to decrease the burning resonance noise to effect a low noise operation of the water heating apparatus U which does not disturb people in the home where it is used or in surrounding homes.

Figure 8A:
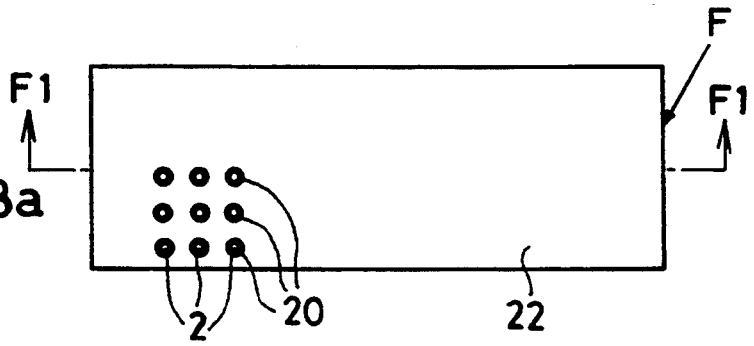
Figure 8B:
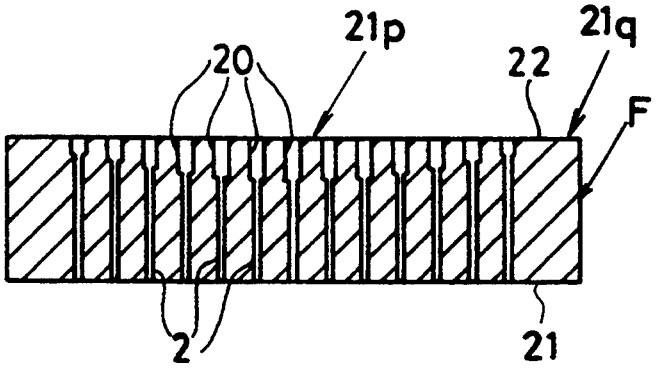

FIGS. 8*a*, 8*b* show the sixth embodiment of the invention in which the flat type burner plate F is provided which measures 92 mm×140 mm and 13 mm in thickness. The burner plate F has a multitude of lattice-like fire holes 2 each piercing through its thickness. Each of the fire holes 2 measures 1.9 mm in diameter and 4 mm in center-to-center distance. The burner plate F has the countersink 20 provided on the upper surface 22 of the fire holes 2 of the burner plate F. The countersink 20 measures 4.5 mm in diameter and 1.5~3.5 mm in depth. The depth of the countersink 20 progressively decreases from the central portion 21*p* to the outer periphery 21*q* so as to form a concave envelope curve provided by connecting each bottom end of the countersinks. It is noted that the bottom ends of countersinks may be made so that they form a V-shaped envelope.

Figure 9A:
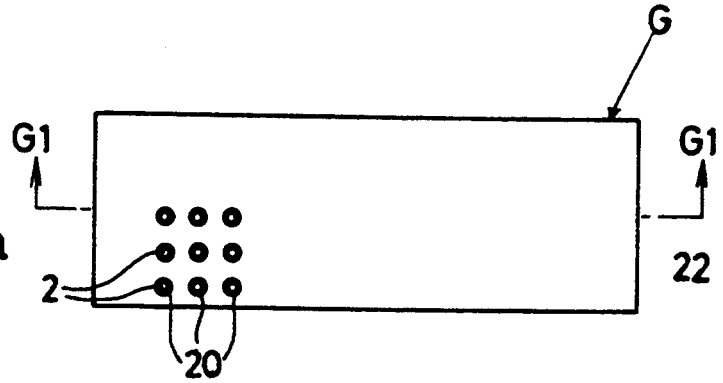
Figure 9B:
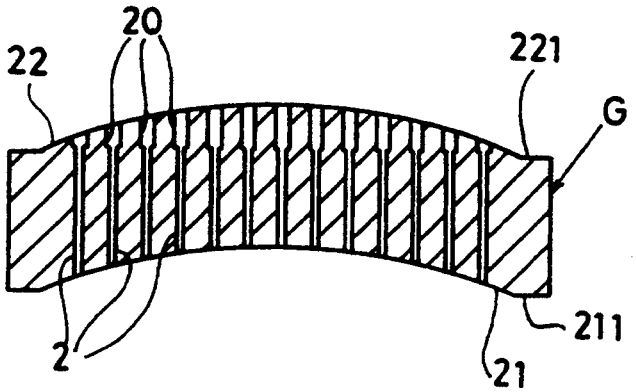

FIGS. 9*a*, 9*b* show the seventh embodiment of the invention in which the arcuate burner plate G is provided with the upper and lower surfaces 22, 21 upwardly curved respectively. The burner plate G measures 92 mm×140 mm and 13 mm in thickness. The burner plate G has a multitude of lattice-like fire holes 2 each piercing through its thickness. Each of the fire holes 2 measures 1.9 mm in diameter and 4 mm in center-to-center distance. The burner plate G has the countersink 20 provided on the upper surface 22 of the fire holes 2 of the burner plate G. The countersink 20 measures 4.5 mm in diameter and 1.5~3.5 mm in depth. The depth of the countersink 20 progressively decreases from the central portion 21*p* to the outer periphery 21*q*. In an outer periphery of the burner plate G, a periphery 221 of the upper surface 22 is in horizontal relationship with a periphery 211 of the lower surface 21 to allow it to be readily installed in the burner chamber 102.

Figure 10A:
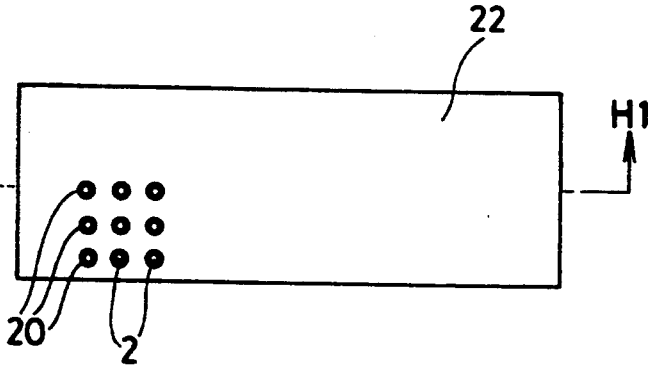
Figure 10B:
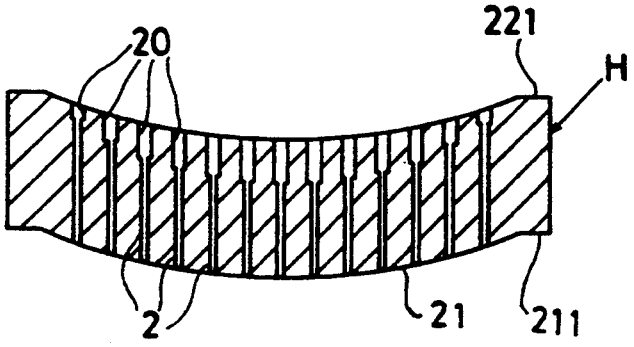

FIGS. 10*a*, 10*b* show the eighth embodiment of the invention in which the arcuate burner plate H is provided with the upper and lower surfaces 22, 21 downwardly curved The burner plate G measures 92 mm×140 mm and 13 mm in thickness. The burner plate H has a multitude of lattice-like fire holes 2 each piercing through its thickness. Each of the fire holes 2 measures 1.9 mm in diameter and 4 mm in center-to-center distance. The burner plate G has the countersink 20 provided on the upper surface 22 of the fire holes 2 of the burner plate G. The countersink 20 measures 4.5 mm in diameter and 1.5~3.5 mm in depth. The depth of the countersink 20 progressively decreases from the central portion 21*p* to the outer periphery 21*q* so as to form a concave envelope curve provided by connecting each bottom end of the countersinks. In an outer periphery of the burner plate H, the periphery 221 of the upper surface 22 is in horizontal relationship with the periphery 211 of the lower surface 21 to be readily installed in the burner chamber 102. It is noted that the bottom ends of countersinks may be made so that they form a V-shaped envelope.

Incidentally, the time period (t) required for the air-fuel mixture gas to pass through the fire holes 2 is determined as follows:

$$t=(L1/V1)+(L2/V2)$$

Where

L1=a dimensional difference between the thickness of the burner plate (F~H) and the depth of the countersink 20 in the fire holes 2, L2=the depth of the countersink 20, V1=velocity of the air-fuel mixture gas passing through a portion of the fire hole except for the countersink 20, V2=velocity of the air-fuel mixture gas passing through the coutersink 20.

Since the former velocity is greater than the latter velocity (V1>V2), the air-fuel mixture gas passes through the fire holes more quickly as the depth L1 increases with the decrease of the depth L2. In the burner plate (F~H), the countersink 20 is provided in the fire holes 2, and the depth of the countersink 20 progressively decreases toward the outer periphery 21*q* of the burner plate. This makes it possible to change the time period needed for the air-fuel mixture gas to pass through the fire holes depending on what part of the burner plate the fire holes are placed. In this instance, the burning heat frequency precedently occurs in the fire holes having shorter countersink through which the air-fuel mixture gas passes more quickly, and thus making it possible to effectively alter the characteristics of the frequency response on the burner plate.

For this reason, the frequency response of the burning heat frequency provided by the resultant frequency of the burner flames on the entire burner plate repeatedly changes from α-state to β-state and vice versa as shown in FIG. 2*a*. As a result, a time lag occurs in the increment of the heat generation speed on the entire burner plate as opposed to the case in which the same time period is required for the air-fuel mixture gas to pass through the fire holes irrespective of where the fire holes are located on the burner plate. This makes it possible to lag the phase of the frequency response of the burner heat frequency behind the characteristic frequency wave of the acoustic system, and thus enabling to avoid the resonance with the characteristic frequency wave of the acoustic system. Further, it is possible to cancel the frequency response of the burner heat frequency of the burner flame in α-state with that of the burner flame in β-state so as to decrease the amplitude of the entire frequency response of the burner heat frequency. The reduced amplitude of frequency response makes it possible to decrease the burning resonance noise to effect a low noise operation of the water heating apparatus U which does not disturb people in the home where it is used or in surrounding homes. It is observed that the depth of the countersink of the fire holes may progressively increase from the central portion toward the outer periphery of the burner plate.

Figure 11A:
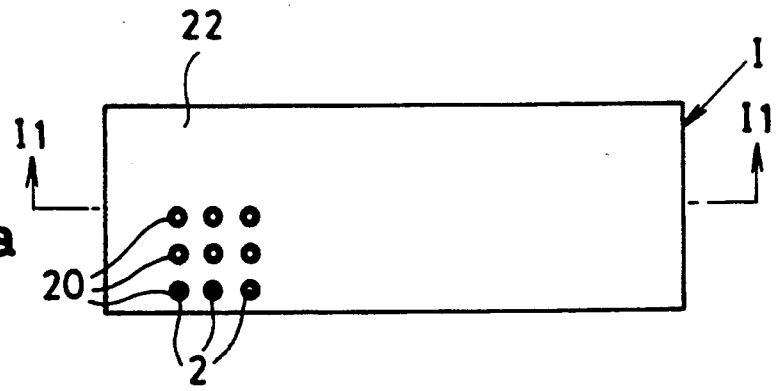
Figure 11B:
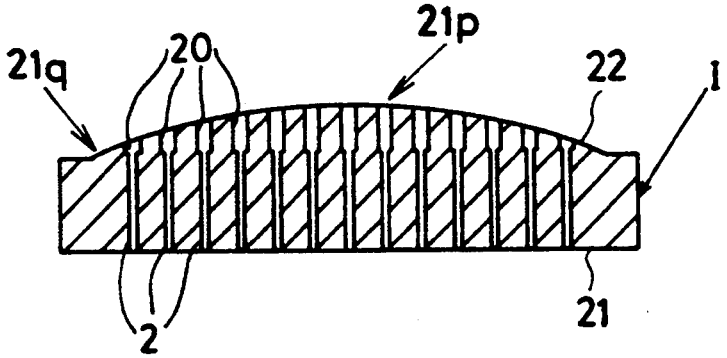

FIGS. 11*a*, 11*b* show the ninth embodiment of the invention in which the burner plate I is generally identical to the burner plate A except for the provision of the countersink 20. The countersink 20 is provided in the fire holes 2 in the upper side 22 of the burner plate I. The depth of the countersink 20 ranges from 1.5 mm to 3.5 mm, and progressively decreases from the central portion 21*p* toward the outer periphery 21*q* of the burner plate I. It is noted that the depth of the countersink may be arranged so that a V-shaped envelope is formed by connecting the bottom ends of the countersink respectively.

Figure 12A:
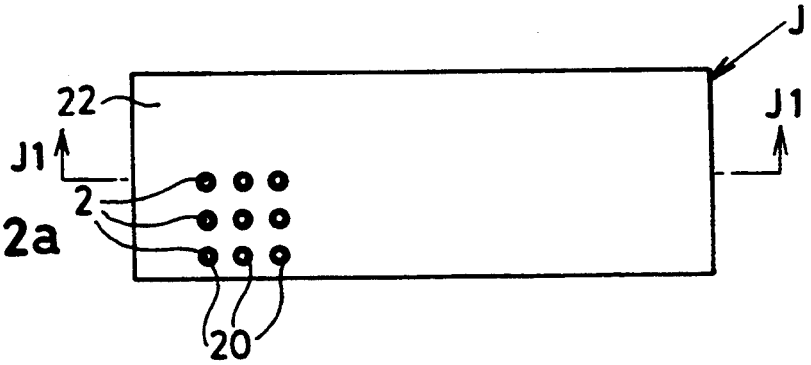
Figure 12B:
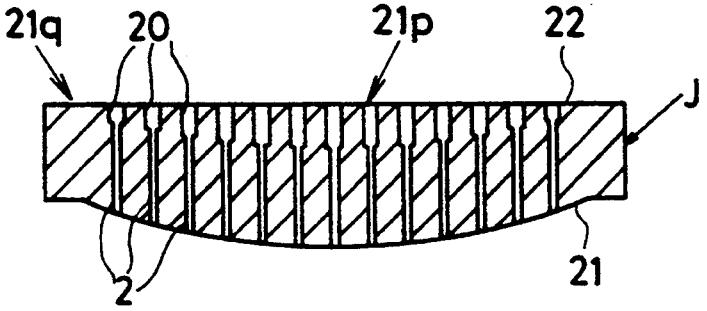
Figure 13:
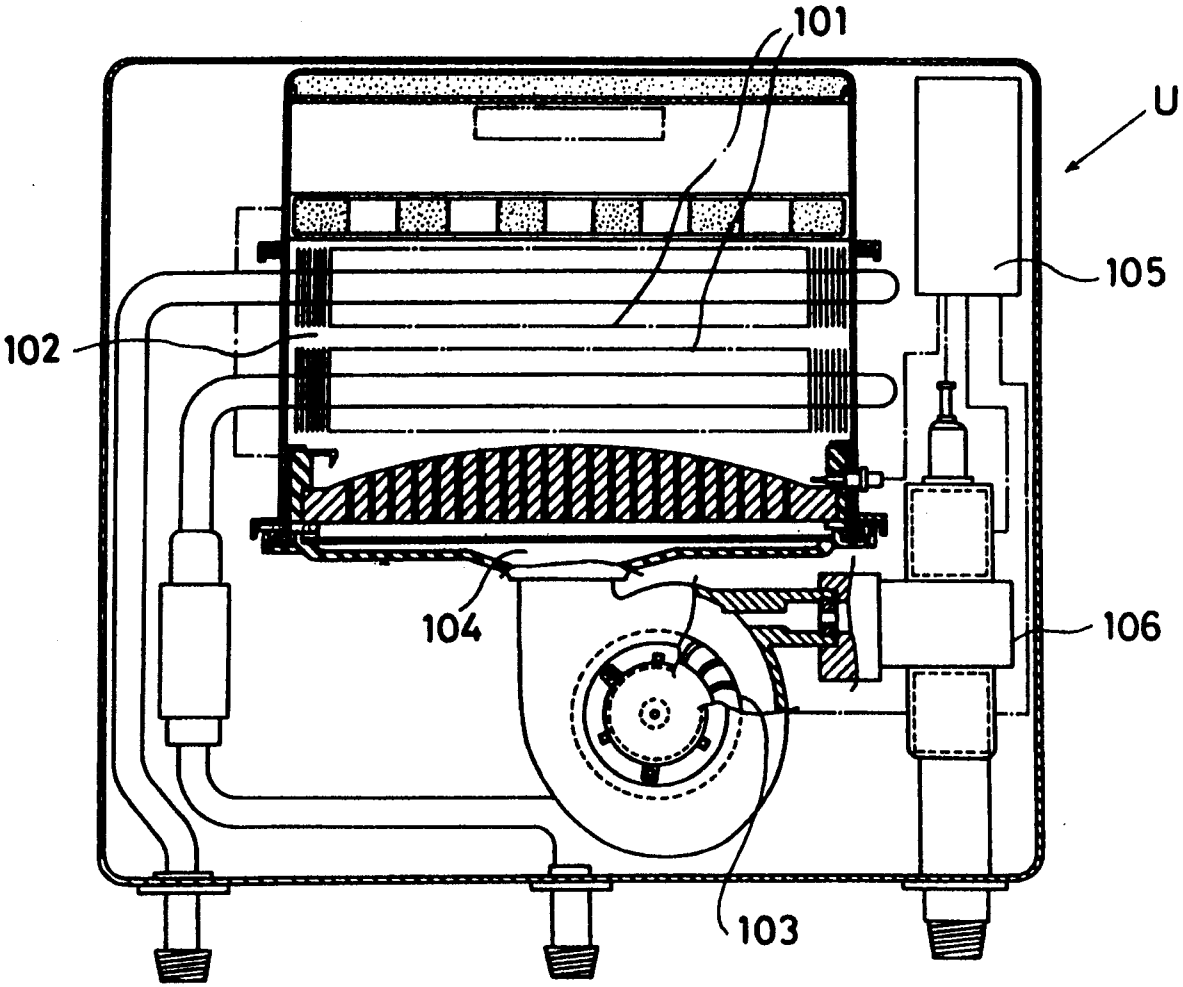

FIGS. 12*a*, 12*b* show the tenth embodiment of the invention in which the burner plate J is generally identical to the plate burner A except for the provision of the countersink 20. The countersink 20 is provided in the fire holes 2 in the upper side 22 of the burner plate I. The depth of the countersink 20 ranges from 1.5 mm to 3.5 mm, and progressively decreases from the central portion 21*p* toward the outer periphery 21*q* of the burner plate J.

According to the ninth and tenth embodiments of the invention, the thickness of the burner plates I, J progressively decreases from the central portion toward the outer periphery of the burner plates, and the depth of the countersink progressively decreases from the central portion toward the outer periphery. This makes it possible to change the time period needed for the air-fuel mixture gas to pass through the fire holes depending on what part of the burner plate the fire holes are located. In this instance, the burning heat frequency precedently occurs in the fire holes which are placed in the thickness-reduced portion of the burner plate, and having shorter countersink through which the air-fuel mixture gas passes more quickly, and thus making it possible to effectively alter the characteristics of the frequency response on the burner plate. It is observed that the thickness of the burner plate and the depth of the fire holes are simultaneously arranged such that the time lag is readily provided among the flames built on the fire holes of the burner plate. It is also observed that the thickness of the burner plate may progressively increase from the central portion toward the periphery, while the depth of the countersink may progressively increase from the central portion toward the periphery.

Figure 14A:
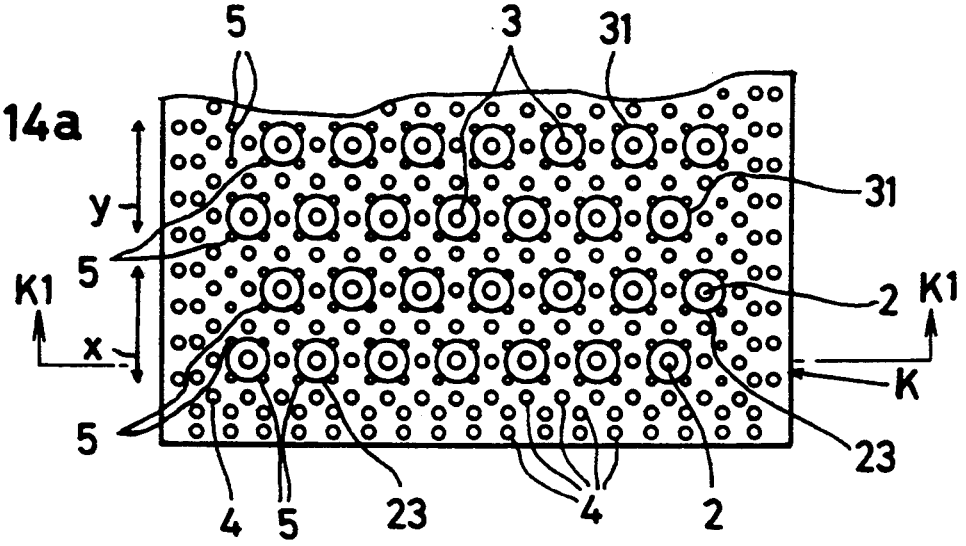
Figure 14B:
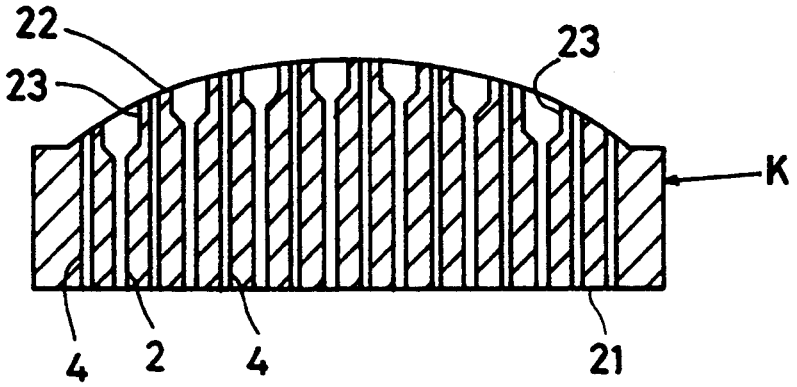
Figure 16A:
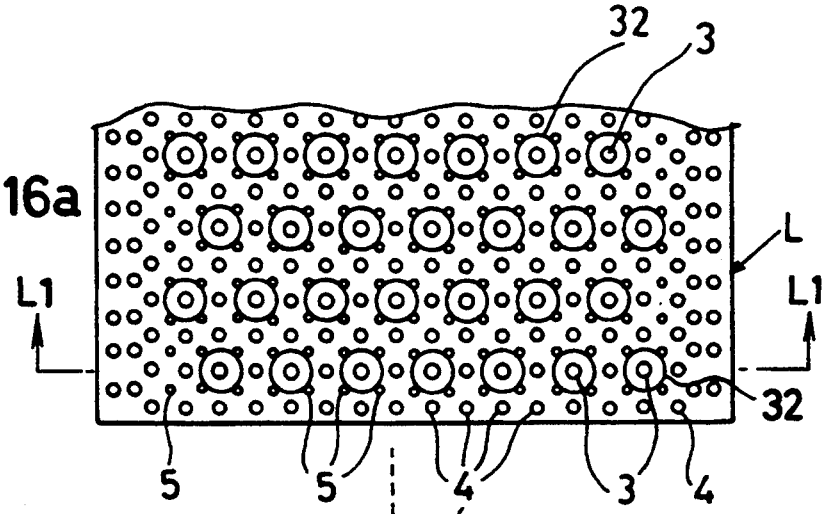
Figure 16B:
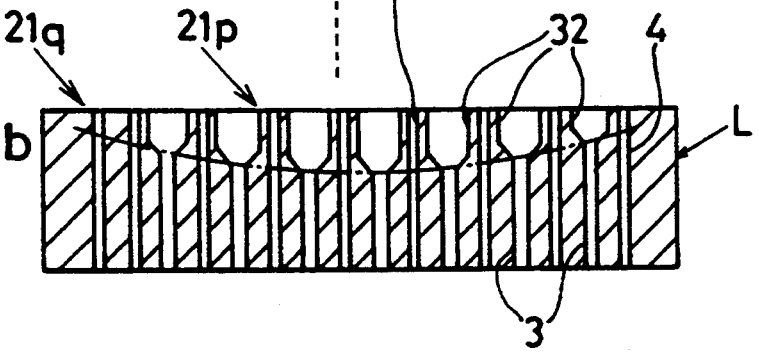

FIGS. 14*a*, 14*b* show an eleventh embodiment of the invention in which a burner plate L is provided. FIGS. 16*a*, 16*b* show a twelfth embodiment of the invention in which a burner plate K is provided. The burner plates L, K are in turn incorporated into the water heating appratus U as shown in FIG. 13.

The burner plate K measures 92 mm×140 mm and 16~25 mm in thickness as shown in FIGS. 3*a*, 3*b*. The burner plate K has a convex-shaped configuration at its upper surface 22, and alternately having two rows (x), (y) of primary and secondary fire holes 2, 3 with regular intervals (8 mm). The primary fire holes 2 are 1.9 mm in diameter, and the secondary fire holes 2 are 1.7 mm in diameter. Countersinks 23, 31 are in turn provided in the row of the primary and secondary fire holes 2, 3. The countersink 23 is 4.5 mm in diamter and 1.5 mm in depth, while the countersink 31 is 4.5 mm in diameter and 3.5 mm in depth. On the burner plate K, a multitude of tiny fire holes 4, 5 (1.3 mm, 0.9 mm in dia.) are provided, part of which are located to surround the countersinks 23, 31.

With the fire holes 2, 3, 4 and 5 of different diameter provided on the burner plate, they play a role of stabilizing the flames built on the burner plate in the range from a low heating capacity region to a high heating capacity region. The countersinks 23, 31 contribute to reducing the velocity of the air-fuel gas passing through the fire holes so as to stabilize the flames on the burner plate.

With two rows (x), (y) of primary and secondary fire holes 2, 3 alternately provided on the burner plate, the frequency response of the burning heat oscillation in α-state flame and the frequency response of the burning heat oscillation in β-state flame in turn occur. However, the two responses are cancelled each other so as to be advantageous in preventing the resonance noise.

Figure 15A:
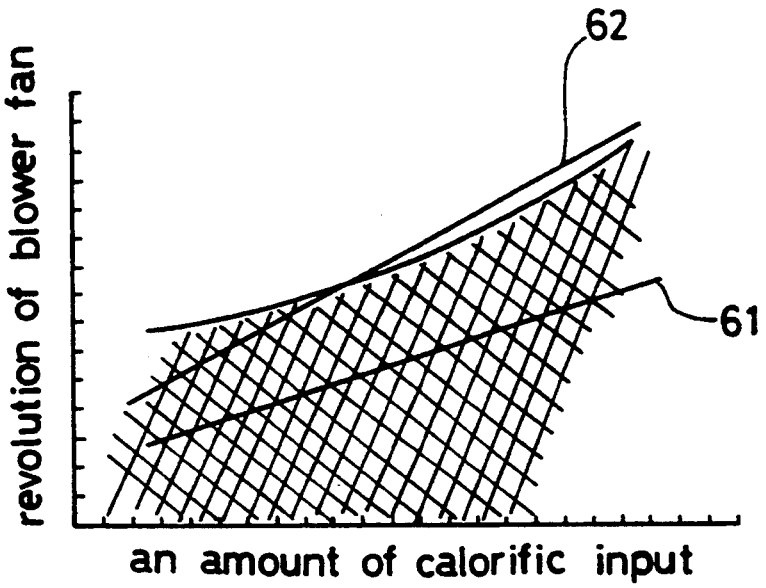
Figure 15B:
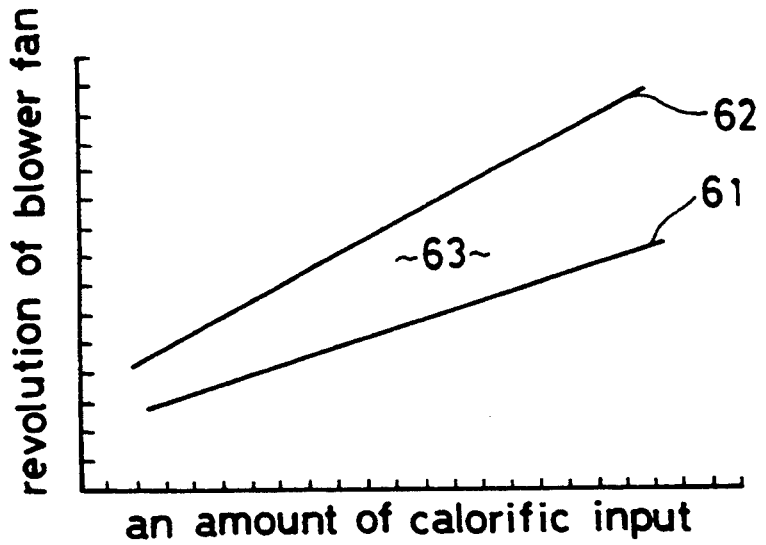

FIGS. 15*a*, 15*b* show graphs each depicting a relationship between an amount of calorific input and revolution of the blower fan. The resonance noise occurs in the region as depicted by the hatched lines in FIG. 15*a* when the prior burner plate is incorporated into the water heating apparatus U.

On the contrary, the water heating apparatus U remains substantially immune to the resonance noise in a good burning region 63 surrounded by an unburnable-limit line 61 and flame lift-limit line 62 as shown in FIG. 15*b* when the burner plate (A~K) is incorporated into the water heating apparatus U.

Figure 16C:
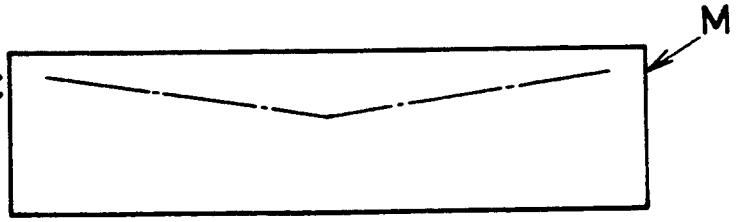

Returning back to the flat type burner plate L of the twelfth embodiment of the invention, the flat type burner plate L measures 92 mm×140 mm, and 16 mm in depth. Many a row of the secondary fire holes 3 (1.7 mm in dia.) are provided in the flat burner plate L with regular intervals (8 mm). In each row of the secondary fire holes 3, countersink 32 is provided such that its depth progressively decreases from the central portion 21*p* toward the outer periphery 21*q* of the burner plate L. Such is the depth of the countersink 32 that a convex envelope curve is formed by in turn connecting the bottom end of the countersink 32 in the fire holes 3 as shown in FIG. 16*b*. It is noted that the depth of the countersink 32 may be arranged so that the envelope forms a V-shaped configuration as shown at M in FIG. 16*c* as a modification of the twelfth embodiment of the invention. It is found that the water heating apparatus U remains substantially immune to the resonance noise as the case with the burner plate K when the burner plate L is incorporated into the water heating apparatus U.

It is noted that the invention is applied to not only the water heating apparatus but also an air conditioner, gas grill, clothes dryer and the like.

It is also noted that the diameter and interval of the fire holes, the depth and diameter of the countersink and the thickness of the burner plate are appropriately arranged as required upon putting it into practical use.

It is appreciated that the countersink may be provided in all the fire holes, or otherwise it may be partly provided in the fire holes.

It is further appreciated that the thickness of the burner plate and the depth of the countersink may be longitudinally and latitudinally changed from the central portion toward the outer periphery of the burner plate.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. A burner plate adapted to be disposed in a burner chamber defining an acoustic system having a characteristic frequency, said burner plate comprising:

a multitude of first fire holes each extending through a thickness of the burner plate so as to effect a primary burning thereon with a high heat capacity;

means for preventing resonance noise induced when a phase of a resonant burning heat frequency becomes superposed with a phase of said acoustic system characteristic frequency, said preventing means comprising a countersink provided on an upper end of the fire holes to increase their diameter, a depth of the countersink being progressively increased or reduced from a central portion toward an outer periphery of the burner plate.

2. A burner plate as recited in claim 1, in which a plurality of small second fire holes are provided around the countersink.

3. A burner plate adapted to be disposed in a burner chamber defining an acoustic system having a characteristic frequency, said burner plate comprising:

a multitude of first fire holes each extending through a thickness of the burner plate so as to effect a primary burning thereon with a high heat capacity;

means for preventing resonance noise induced when a phase of a resonant burning heat frequency becomes superposed with a phase of said acoustic system characteristic frequency, said preventing means comprising a countersink of substantial uniform depth provided on an upper end of the fire holes to increase their diameter; said burner plate varying in thickness from its center outwardly and a plurality of small second fire holes provided around the countersinks.

4. A burner plate as recited in claim 1 wherein the burner varies in thickness from its center outwardly.

* * * * *